US009383694B2

(12) United States Patent
Yoshikawa

(10) Patent No.: US 9,383,694 B2
(45) Date of Patent: Jul. 5, 2016

(54) IMAGE FORMING DEVICE PROVIDED WITH CLEANER, WASTE TONER ACCOMMODATING PORTION, AND PAPER GUIDE DISPOSED BETWEEN CLEANER AND WASTE TONER ACCOMMODATING PORTION

(71) Applicant: Brother Kogyo Kabushiki Kaisha, Nagoya-shi, Aichi-ken (JP)

(72) Inventor: Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/844,972

(22) Filed: Sep. 3, 2015

(65) Prior Publication Data

US 2015/0378288 A1 Dec. 31, 2015

Related U.S. Application Data

(63) Continuation of application No. 14/480,087, filed on Sep. 8, 2014, now Pat. No. 9,128,423, which is a continuation of application No. 13/427,977, filed on Mar. 23, 2012, now Pat. No. 8,831,470.

(30) Foreign Application Priority Data

Jul. 29, 2011 (JP) ..... 2011-167450

(51) Int. Cl.

| | |
|---|---|
| ***G03G 15/00*** | (2006.01) |
| ***G03G 15/01*** | (2006.01) |
| ***G03G 15/16*** | (2006.01) |
| ***G03G 21/12*** | (2006.01) |
| ***G03G 15/20*** | (2006.01) |

(52) U.S. Cl.

CPC ..... *G03G 15/2025* (2013.01); *G03G 15/0189* (2013.01); *G03G 15/161* (2013.01); *G03G 21/12* (2013.01); *G03G 2215/0132* (2013.01); *G03G 2215/1661* (2013.01)

(58) Field of Classification Search

CPC ..... G03G 15/161; G03G 15/0189; G03G 21/169; G03G 21/168; G03G 2215/1661

USPC ..... 399/101, 110, 121, 123, 302

See application file for complete search history.

(56) References Cited

U.S. PATENT DOCUMENTS

| | | | |
|---|---|---|---|
| 7,437,118 | B2 | 10/2008 | Ahn et al. |
| 8,000,628 | B2 | 8/2011 | Sato et al. |

(Continued)

FOREIGN PATENT DOCUMENTS

| | | | |
|---|---|---|---|
| JP | 2009-210937 | A | 9/2009 |
| JP | 2010-256827 | A | 11/2010 |

*Primary Examiner* — William J Royer

(74) *Attorney, Agent, or Firm* — Banner & Witcoff, Ltd.

(57) ABSTRACT

An image forming device includes: a photosensitive drum; a first roller; a second roller; an intermediate transfer belt; a transfer roller; a cleaner; a waste toner accommodating portion; and a paper guide. The intermediate transfer belt is looped around the first roller and the second roller to circularly move in a moving direction. The intermediate transfer belt contacts the photosensitive drum. The transfer roller is disposed opposite to the first roller with respect to the intermediate transfer belt. The cleaner collects waste toner on the intermediate transfer belt. The cleaner is disposed upstream of the photosensitive drum in the moving direction and downstream of the transfer roller in the moving direction. The waste toner accommodating portion accommodates the waste toner collected by the cleaner. The paper guide guides a recording medium and disposed between the cleaner and the waste toner accommodating portion.

18 Claims, 8 Drawing Sheets

(56) References Cited

U.S. PATENT DOCUMENTS

| | | | | |
|---|---|---|---|---|
| 8,626,026 | B2 | 1/2014 | Yoshikawa | |
| 8,831,470 | B2 | 9/2014 | Yoshikawa | |
| 9,128,423 | B2 * | 9/2015 | Yoshikawa | G03G 15/0189 |
| 2009/0226205 | A1 | 9/2009 | Sato et al. | |
| 2010/0272467 | A1 | 10/2010 | Sato et al. | |

* cited by examiner

IMAGE FORMING DEVICE PROVIDED WITH CLEANER, WASTE TONER ACCOMMODATING PORTION, AND PAPER GUIDE DISPOSED BETWEEN CLEANER AND WASTE TONER ACCOMMODATING PORTION

CROSS REFERENCE TO RELATED APPLICATION

This application is a continuation of U.S. application Ser. No. 14/480,087 filed Sep. 8, 2014, which is a continuation of U.S. application Ser. No. 13/427,977 filed Mar. 23, 2012, which claims priority from Japanese Patent Application No. 2011-167450 filed Jul. 29, 2011. The entire contents of the above-noted applications are incorporated herein by reference.

TECHNICAL FIELD

The present invention relates to an image-forming device provided with a cleaning unit such as a color laser printer.

BACKGROUND

There is known, as a color laser printer of an electrophotographic type, a tandem-type color laser printer provided with a plurality of photosensitive drums arranged in parallel in correspondence with toners of four colors of yellow, magenta, cyan, and black.

As such a tandem-type color laser printer, there is proposed a configuration in which a plurality of photosensitive drums are arranged in parallel above a belt unit having an endless intermediate transfer belt and are brought into contact with the intermediate transfer belt from above.

In the proposed configuration, the belt unit further includes a plurality of primary transfer rollers, a secondary transfer roller, and a cleaning unit.

The primary transfer rollers are arranged opposite to the corresponding photosensitive drums across the intermediate transfer belt. The secondary transfer roller is arranged on the downstream side relative to the downstream most primary transfer roller in the traveling direction of the intermediate transfer belt. The cleaning unit is arranged between the secondary transfer roller and the upstream most primary transfer roller in the traveling direction of the intermediate transfer belt.

When the intermediate transfer belt starts to travel in an image-forming operation, developer images of respective colors carried on the surfaces of the photosensitive drums are sequentially primary-transferred from the photosensitive drums onto the intermediate transfer belt. As a result, a color developer image is formed on the intermediate transfer belt. Thereafter, when the color developer image on the traveling intermediate transfer belt has reached a position opposite to the secondary transfer roller, a paper sheet is supplied between the secondary transfer roller and the intermediate transfer belt. As a result, the color developer image is secondary-transferred onto the paper sheet. The paper sheet onto which the color developer image has been formed is conveyed to a fixing unit, followed by fixing of the color developer image onto the paper sheet.

After completion of the secondary transfer of the color developer image onto the paper sheet, transfer residual toner remains on the peripheral surface of the intermediate transfer belt. When the transfer residual toner remaining on the surface of the traveling intermediate transfer belt has reached to a position opposite to the cleaning unit, the transfer residual toner is collected by the cleaning unit. The toner can also remain on the peripheral surface of the intermediate transfer belt when a patch test is performed. The cleaning unit is configured to collect not only the transfer residual toner but also residual toner generated by the patch test.

SUMMARY

However, in the above-proposed configuration, size reduction of the image-forming device is difficult.

That is, the cleaning unit needs to be arranged between the secondary transfer roller and the upstream most primary transfer roller in the travel direction of the intermediate transfer belt. On the other hand, a conveying path for conveying the paper sheet between the secondary transfer roller and the intermediate transfer belt is also formed around the secondary transfer roller. Therefore, a space for mounting the cleaning unit is restricted.

Further, the cleaning unit needs to have a certain capacity for storing waste toner collected from the intermediate transfer belt. Therefore, there is a limit to the size reduction of the cleaning unit itself.

Thus, arranging the cleaning unit between the secondary transfer roller and the upstream most primary transfer roller while ensuring the capacity of the cleaning unit without interfering with the conveying path inevitably leads to an increase in the size of the entire image-forming device.

In view of the foregoing, it is an object of the invention to provide an image-forming device capable of achieving size reduction while ensuring the capacity of the cleaning unit.

In order to attain the above and other objects, the invention provides an image forming device that may include: a photosensitive drum; a first roller; a second roller; an intermediate transfer belt; a transfer roller; a cleaner; a waste toner accommodating portion; and a paper guide. The intermediate transfer belt may be looped around the first roller and the second roller to circularly move in a moving direction. The intermediate transfer belt may be configured to contact the photosensitive drum. The transfer roller may be disposed opposite to the first roller with respect to the intermediate transfer belt. The cleaner may be configured to collect waste toner on the intermediate transfer belt. The cleaner may be disposed upstream of the photosensitive drum in the moving direction and downstream of the transfer roller in the moving direction. The waste toner accommodating portion may be configured to accommodate the waste toner collected by the cleaner. The paper guide may be configured to guide a recording medium and disposed between the cleaner and the waste toner accommodating portion.

According to another aspect, the present invention provides an image forming device that may include: a photosensitive drum; an intermediate transfer belt; a cleaner; a waste toner accommodating portion; and a paper guide. The intermediate transfer belt may be arranged in confrontation with the photosensitive drum. The cleaner may contact the intermediate transfer belt to collect waste toner on the intermediate transfer belt. The waste toner accommodating portion may be configured to accommodate the waste toner collected by the cleaner. The paper guide may be configured to guide a recording medium and disposed between the cleaner and the waste toner accommodating portion.

BRIEF DESCRIPTION OF THE DRAWINGS

The particular features and advantages of the invention as well as other objects will become apparent from the following description taken in connection with the accompanying drawings, in which.

DETAILED DESCRIPTION

<First Embodiment>

1. Entire Configuration of Color Printer

Figure 1:
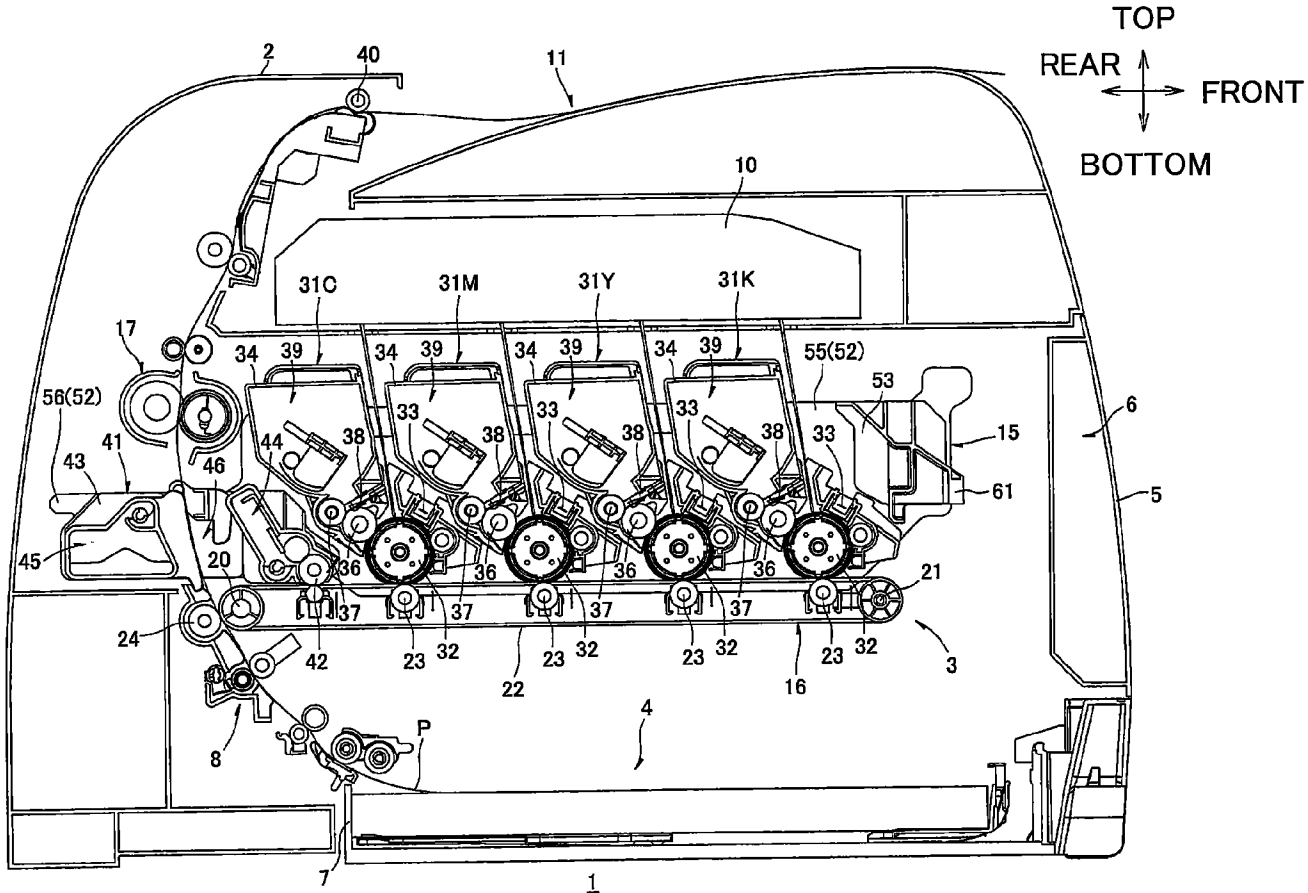
FIG. 1 is a cross-sectional side view of a color printer according to a first embodiment of the present invention.

As illustrated in FIG. 1, a color printer 1 (an example of an image-forming device) is a horizontally-placed intermediate transfer type color printer.

The color printer 1 includes a main casing 2. The main casing 2 incorporates an image-forming section 3 and a paper feeding section 4 for feeding a paper sheet P to the image-forming section 3.

(1) Main Casing

The main casing 2 is formed into substantially a rectangular box shape as viewed from side. A main body side opening portion 6 for communicating between the inside and outside of the main casing 2 is formed in one side wall of the main casing 2. Further, a front cover 5 is provided in the same side wall of the main casing 2. The front cover 5 is provided so as to be swingable about the lower end portion thereof between an opening position at which the upper end portion thereof is separated from the main casing 2 to open the main body side opening portion 6 and a closing position at which the upper end portion contacts the main casing 2 to close the main body side opening portion 6.

Hereinafter, a side (right side of FIG. 1) at which the front cover 5 is provided is defined as a "front side" of the color printer 1, and the opposite side (left side of FIG. 1) is defined as a "rear side". The left and right sides are set with reference to the color laser printer 1 as viewed from the front side. In other words, the front side in the plane of FIG. 1 is the left side, and the rear side in the plane of FIG. 1 is the right side.

(2) Paper Feeding Section

The paper feeding section 4 includes a paper feeding tray 7 storing the paper sheets P.

The paper feeding tray 7 is detachably mounted on the bottom portion in the main casing 2. A conveying path 8 extending from the rear end of the paper feeding tray 7 toward the image-forming section 3 (space between a belt unit 16 and a secondary transfer roller 24, both of which will be described later) is formed in the main casing 2.

The paper sheets P stored in the paper feeding tray 7 are picked up one by one by various rollers. The picked up paper sheet P is fed to the conveying path 8 and then to the image-forming section 3 along the conveying path 8.

(3) Image-Forming Section

The image-forming section 3 is arranged above the paper feeding section 4 and includes an exposure unit 10, a drum unit 15 (an example of a pull-out member), the belt unit 16, and a fixing unit 17 (an example of a fixing member).

(3-1) Exposure Unit

The exposure unit 10 is disposed at the uppermost position inside the main casing 2. The exposure unit 10 emits four laser beams corresponding to respective colors toward corresponding photosensitive drums 32 (to be described later).

(3-2) Drum Unit

The drum unit 15 is disposed inside the main casing 2 at a portion above the paper feeding section 4 and below the exposure unit 10. The drum unit 15 is mounted so as to be slidable in the front-rear direction to a housing position (see FIGS. 1 and 6) at which the drum unit 15 is housed in the main casing 2 and a pull-out position (see FIG. 5) at which the drum unit 15 is outside the main casing 2 when the front cover 5 is opened.

The drum unit 15 includes four photosensitive drums 32 (an example of photosensitive members). Each of the four photosensitive drums 32 is rotatably supported about an axial line extending in the left-right direction. The four photosensitive drums 32 are arranged in parallel and spaced apart from each other so as to sequentially correspond to four colors of black, yellow, magenta, and cyan in the front-rear direction.

The drum unit 15 includes four scorotron chargers 33. The four scorotron chargers 33 correspond respectively to the four photosensitive drums 32 and are each disposed on the upper-front side of the corresponding photosensitive drum 32.

The drum unit 15 further includes four developer cartridges 31. The developer cartridges 31 are arranged in parallel and spaced apart from each other in the front-rear direction. More specifically, a black developer cartridge 31K, a yellow developer cartridge 31Y, a magenta developer cartridge 31M and a cyan developer cartridge 31C are sequentially arranged from the front side toward the rear side.

Each developer cartridge 31 is detachably attached to the drum unit 15 and includes a developer frame 34, a developing roller 36 housed in the developer frame 34, a supply roller 37, and a layer-thickness regulating blade 38.

The developing roller 36 is rotatably supported by the developer frame 34 such that the lower side thereof is exposed from the developer frame 34. The supply roller 37 is rotatably supported by the developer frame 34 so as to contact the developing roller 36 from above. The layer-thickness regulating blade 38 is supported by the developer frame 34 so as to be brought into press-contact with the developing roller 36. The developer frame 34 includes, at a portion above the supply roller 37, a toner accommodating portion 39 for accommodating toners of respective colors.

The drum unit 15 supports a cleaning unit 41. The configuration of the cleaning unit 41 will be described later.

(3-3) Belt Unit

As illustrated in FIG. 1, the belt unit 16 is disposed inside the main casing 2 at a portion above the paper feeding section 4 and below the drum unit 15 set at the housing position.

The belt unit 16 includes a driving roller 20 (an example of a first roller), a driven roller 21 (an example of a second roller), an intermediate transfer belt 22 (an example of an endless belt), and four primary transfer rollers 23.

The driving roller 20 and the driven roller 21 are arranged opposite to and spaced apart from each other in the front-rear direction. More specifically, the driving roller 20 is disposed spaced apart rearward from the rearmost photosensitive drum 32 by a distance equal to or more than the front-rear direction length of a first waste toner accommodating portion 44 (described later) of the cleaning unit 41. The driven roller 21 is disposed frontward of the frontmost photosensitive drum 32 in the front-rear direction.

The intermediate transfer belt 22 is an endless belt spanned between the driving roller 20 and the driven roller 21. The intermediate transfer belt 22 spanned between the driving roller 20 and the driven roller 21 forms a pair of straight planes extending in the front-rear direction. The four photosensitive drums 32 face the upper straight portion. The intermediate transfer belt 22 is circularly moved with the drive movement of the driving roller 20 and the driven movement of the driven roller 21 such that the upper portion thereof moves from the rear side toward the front side.

The primary transfer rollers 23 are arranged in parallel and spaced apart from each other in the front-rear direction. Each primary transfer roller 23 is opposite to the corresponding photosensitive drum 32 across the upper portion of the intermediate transfer belt 22.

The secondary transfer roller 24 (an example of a transfer member) is disposed rearward of the belt unit 16.

The secondary transfer roller 24 is opposed to the driving roller 20 of the belt unit 16 across the intermediate transfer belt 22 from the rear side so that the upper end thereof is disposed below the upper portion of the intermediate transfer belt 22.

(3-4) Fixing Unit

The fixing unit 17 is disposed above the secondary transfer roller 24 and includes a heating roller and a pressure roller opposite to the heating roller.

(3-5) Image Forming Operation (3-5-1) Developing Operation

The toner in the toner accommodating portion 39 is fed to the supply roller 37 and further to the developing roller 36.

The toner that has been fed to the developing roller 36 is regulated in thickness by the layer-thickness regulating blade 38 with a rotation of the developing roller 36 and then carried on the surface of the developing roller 36 as a thin layer having a uniform thickness.

The surface of the photosensitive drum 32 is uniformly positively charged by the scorotron charger 33 with a rotation of the photosensitive drum 32 and, thereafter, exposed by laser beams emitted from the exposure unit 10. As a result, an electrostatic latent image corresponding to an image to be formed on the paper sheet P is formed on the surface of the photosensitive drum 32.

Further rotation of the photosensitive drum 32 causes the positively charged toner carried on the surface of the developing roller 36 to be fed to the electrostatic latent image formed on the surface of the photosensitive drum 32. As a result, the electrostatic latent image formed on the photosensitive drum 32 is visualized, and a toner image resulting from reversal development is carried on the surface of the photosensitive drum 32.

(3-5-2) Transfer/Fixing Operation

Toner images of respective colors that have been carried on the surfaces of the photosensitive drums 32 through the reversal development are sequentially primary-transferred onto the upper portion of the intermediate transfer belt 22 moving from the rear side to front side. As a result, a color image is formed on the intermediate transfer belt 22.

At a timing when the color image reaches a portion at which the intermediate transfer belt 22 and the secondary transfer roller 24 are opposite to each other with the circulation of the intermediate transfer belt 22, the paper sheet P is fed from the paper feeding section 4 to the opposing portion between the intermediate transfer belt 22 and secondary transfer roller 24. Further circulation of the intermediate transfer belt 22 causes the color image to be secondary-transferred from the intermediate transfer belt 22 onto the paper sheet P.

Thereafter, the paper sheet P onto which the color image has been transferred is fed upward from the opposing portion between the intermediate transfer belt 22 and the secondary transfer roller 24. Then, the paper sheet P passes through the cleaning unit 41 while being guided by a paper guide section 46 to be described later which is formed in the cleaning unit 41 and is then fed to the fixing unit 17 disposed above the cleaning unit 41.

In the fixing unit 17, the color image transferred onto the paper sheet P is subjected to heating and pressurization while the paper sheet P passes between the heating roller and the pressure roller to be thermally fixed onto the paper sheet P.

(4) Paper Ejection

The paper sheet P onto which the toner image has been fixed in the fixing unit 17 is ejected, by a paper ejection roller 40 formed in the upper portion of the main casing 2, onto a paper ejection tray 11 formed on the upper surface of the main casing 2.

2. Drum Unit

Figure 2:
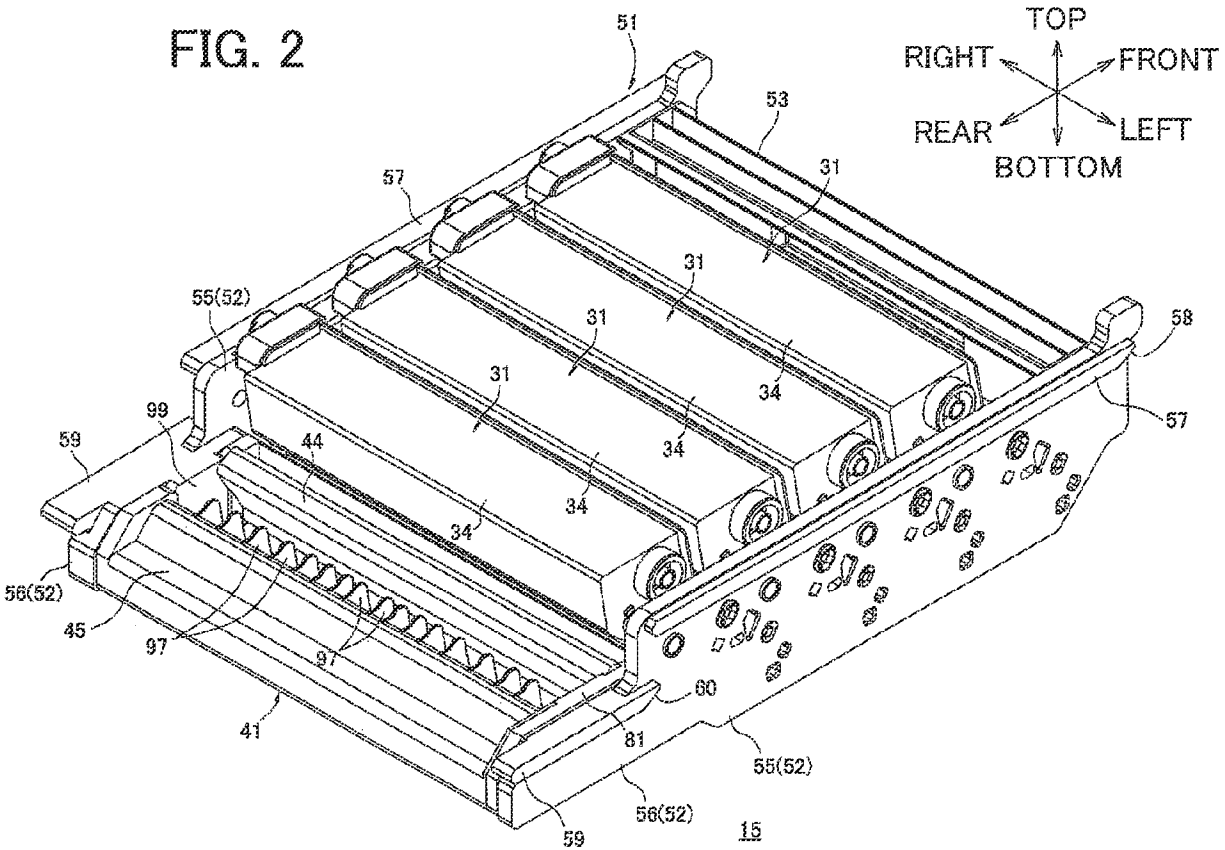
FIG. 2 is a perspective view of a drum unit shown in FIG. 1 when viewed from the left-rear-upper side.
Figure 3:
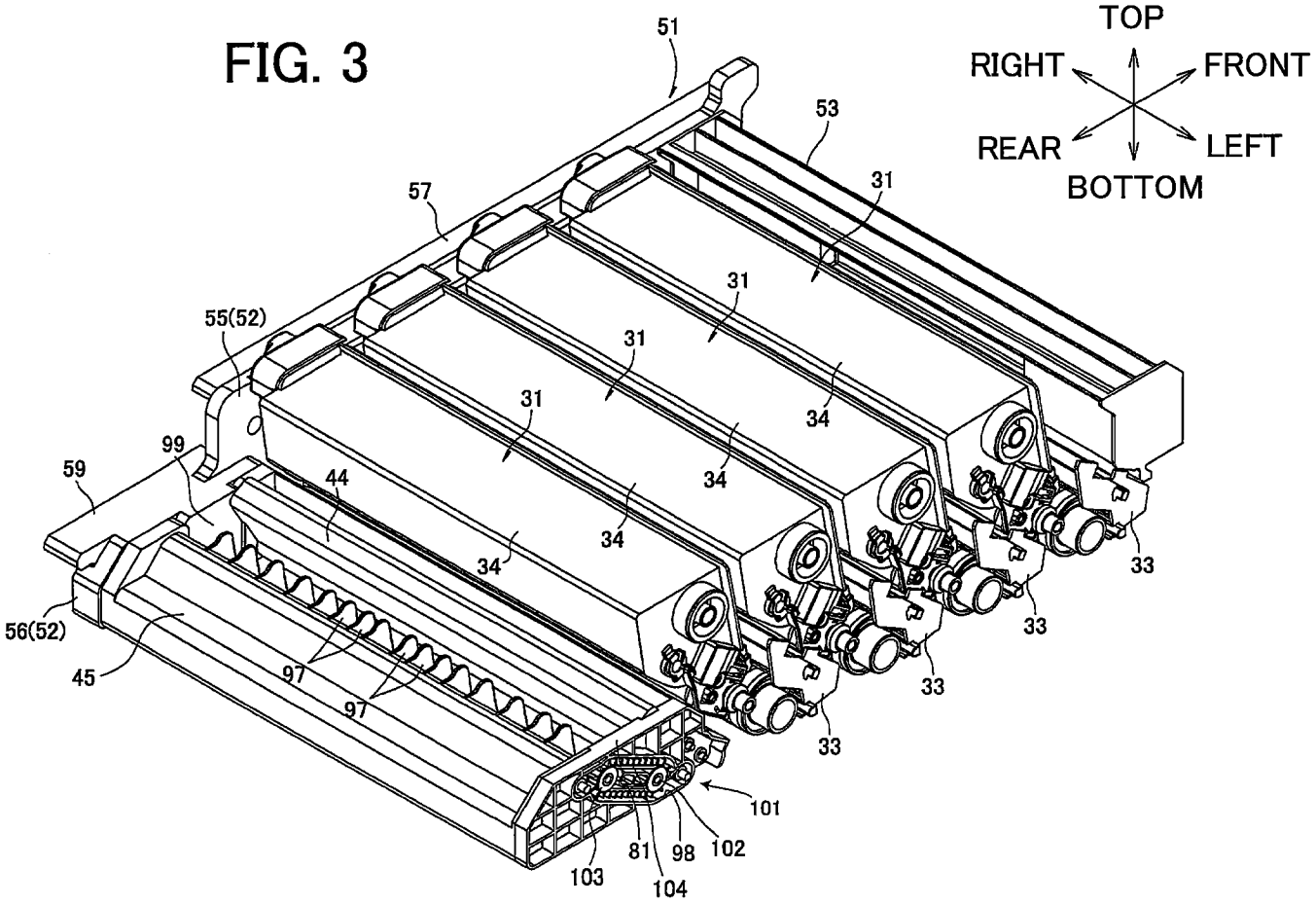
FIG. 3 is a perspective view of the drum unit shown in FIG. 2 when viewed from the left-rear-upper side, where a left frame side plate is removed from the drum unit.

As illustrated in FIGS. 2 and 3, the drum unit 15 includes a drum frame 51 that collectively supports the four photosensitive drums 32 and the four scorotron chargers 33. The drum frame 51 includes the four developer cartridges 31 detachably attached thereto. The drum frame 51 further includes the cleaning unit 41.

(1) Drum Frame

The drum frame 51 is formed into substantially a rectangular frame shape having a bottom and integrally includes a pair of frame side plates 52 which are arranged opposite to and spaced apart from each other in the left-right direction and a frame front plate 53 connecting the front ends of the frame side plates 52.

Each frame side plates 52 integrally includes a first side plate 55 and a second side plate 56.

The first side plate 55 is formed into a flat plate shape extending in the front-rear direction and the up-down direction. The first side plate 55 has a front-rear direction width that is opposite to the frame front plate 53 and the four developer cartridges 31 in the left-right direction.

A first flange portion 57 that protrudes outward in the left-right direction is formed over substantially the entire front-rear width of the upper end of the first side plate 55. A first inclined surface 58 is formed at the front end of the first flange portion 57 so as to be inclined upward toward the front.

The second side plate 56 is formed into a flat plate shape extending in the front-rear direction and the up-down direction. The second side plate 56 extends rearward from substantially the lower half portion of the rear end of the first side plate 55.

A second flange portion 59 that protrudes outward in the left-right direction is formed over substantially the entire front-rear width of the upper end of the second side plate 56. A second inclined surface 60 is formed at the front end of the second flange portion 59 so as to be inclined upward toward the front.

A handle portion 61 (see FIG. 1) having substantially a U-like cross-section protrudes frontward from the frame front plate 53.

(2) Developer Cartridge

Each developer cartridge 31 includes a box-shaped developer frame 34. More specifically, as illustrated in FIG. 1, substantially the upper half of the developer frame 34 is formed into substantially a rectangular shape as viewed from a side and substantially the lower half thereof is formed into a tapered shape such that the rear side surface is inclined frontward toward the lower side.

Further, as illustrated in FIG. 2, the developer frame 34 has a left-right direction width slightly smaller than a distance between the frame side plates 52 of the drum unit 15. Each developer cartridge 31 is detachably attached to between the frame side plates 52 of the drum unit 15.

(3) Cleaning Unit

The cleaning unit 41 is disposed between the pair of second side plates 56 of the drum unit 15. Further, as illustrated in FIG. 1, when the drum unit 15 is at the housing position at which the drum unit 15 is housed in the main casing 2, the cleaning unit 41 is disposed rearward of the rearmost developer cartridge 31 at a portion above the secondary transfer roller 24 and below the fixing unit 17. In other words, when being projected in the up-down direction, the cleaning unit 41 is disposed such that the front-rear direction center portion (the paper guide section 46 (described later), the rear end of the first waste toner accommodating portion 44 (described later) continuously provided from the front side of the paper guide section 46, and the front end of a second waste toner accommodating portion 45 (described later) continuously provided from the rear side of the paper guide section 46) thereof overlaps the fixing unit 17.

The front end (front end of the first waste toner accommodating portion 44 (described later)) of the cleaning unit 41 is formed into a tapered shape inclined downward toward the front. On the other hand, as described above, the rear side surface of each developer frame 34 is inclined frontward toward the lower side. The front end of the cleaning unit 41 is disposed below the developer frame 34 of the rearmost developer cartridge 31C. That is, when being projected in the up-down direction, the front end of the cleaning unit 41 overlaps the developer frame 34 of the rearmost developer cartridge 31C.

The cleaning unit 41 includes a casing 43 (an example of a frame).

The casing 43 includes the first waste toner accommodating portion 44, the second waste toner accommodating portion 45 (an example of a treating member and a waste toner accommodating member) provided on the rear side relative to the first waste toner accommodating portion 44, and a connection portion 81 (FIGS. 2 and 3) connecting the first and second waste toner accommodating portions 44 and 45. The paper guide section 46 (an example of a guide portion) allowing passage of the paper sheet P is formed between the first and second waste toner accommodating portions 44 and 45.

(3-1) First Waste Toner Accommodating Portion

Figure 4:
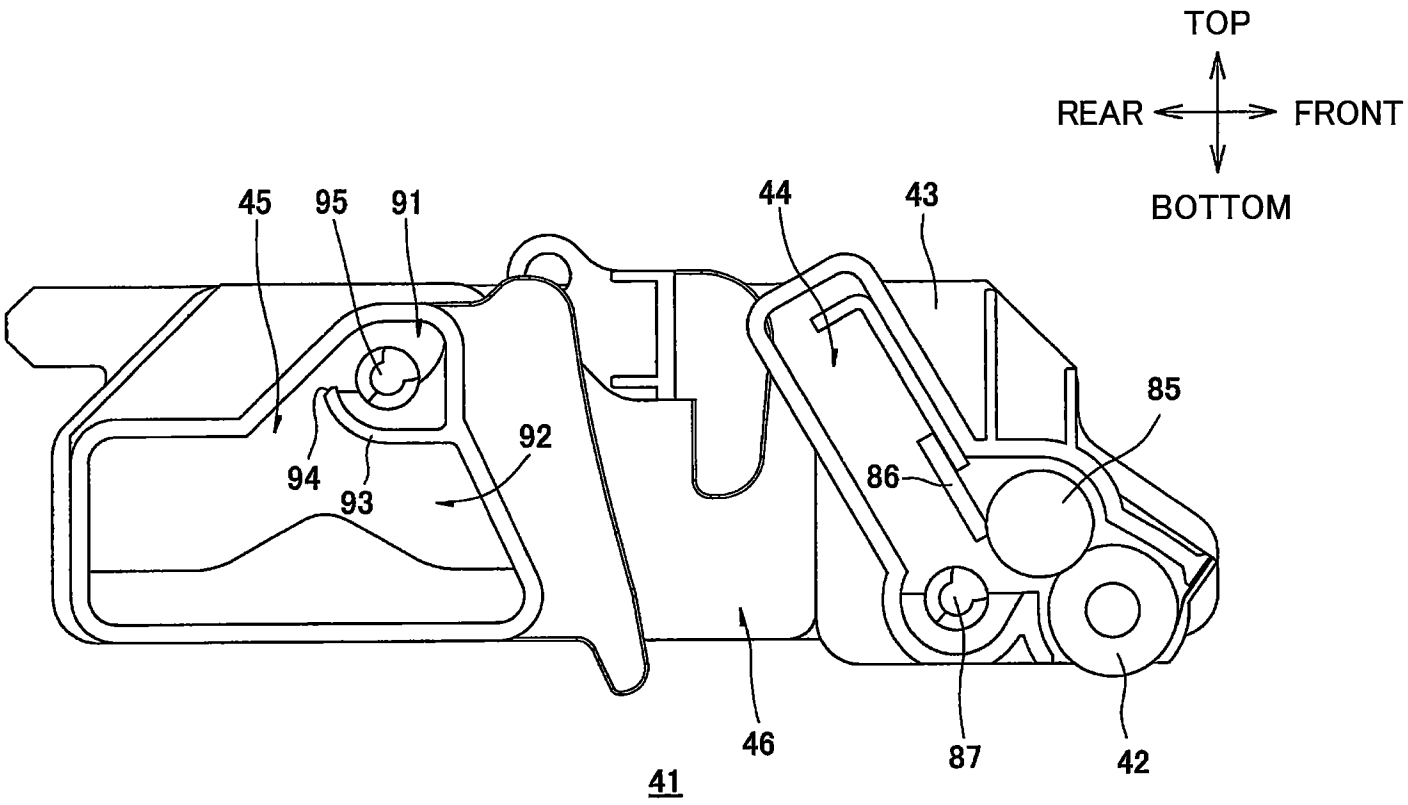
FIG. 4 is an enlarged cross-sectional view of a cleaning unit.

As illustrated in FIG. 4, the first waste toner accommodating portion 44 is formed into substantially a box shape extending from the lower-front side toward the upper-rear side with the front side lower end thereof opened. In the first waste toner accommodating portion 44, a cleaning roller 42 (an example of a cleaning member), a metal roller 85, a scraping member 86, and a first conveying auger 87 (an example of a second conveying member) are accommodated.

The cleaning roller 42 is rotatably provided about an axial line extending in the left-right direction and supported by the first waste toner accommodating portion 44 such that a part of the peripheral surface thereof is exposed downward from the front end of the first waste toner accommodating portion 44.

As illustrated in FIG. 1, when the drum unit 15 is at the housing portion, the cleaning roller 42 is positioned rearward of the rearmost photosensitive drum 32. More specifically, the cleaning roller 42 is disposed so as to be brought into contact from above with the intermediate transfer belt 22 at a portion between the driving roller 20 and the rearmost photosensitive drum 32 in the circulation direction of the intermediate transfer belt 22.

The metal roller 85 is, as illustrated in FIG. 4, rotatably supported at the both ends thereof by the both side walls of the first waste toner accommodating portion 44 so as to be brought into contact from the upper-rear side with the cleaning roller 42.

The scraping member 86 is an elastically deformable blade plate, one end of which is supported by the first waste toner accommodating portion 44 and the other end of which elastically abuts against the peripheral surface of the metal roller 85.

The first conveying auger 87 is rotatably disposed below the scraping member 86 about an axial line extending in the left-right direction.

The first conveying auger 87 includes an auger shaft whose both ends are rotatably supported by the both side walls of the first waste toner accommodating portion 44 and an auger blade formed around the auger shaft and helically extending in the left-right direction.

(3-2) Second Waste Toner Accommodating Portion

The second waste toner accommodating portion 45 is disposed spaced apart rearward from the first waste toner accommodating portion 44 and is formed into substantially a box shape, as viewed from a side, extending in the left-right direction.

The second waste toner accommodating portion 45 includes a partition 93 formed along the left-right direction below a second conveying auger 95 (to be described later). The partition 93 partitions the inner space of the second waste toner accommodating portion 45 into a conveying chamber 91 and a waste toner accommodating chamber 92. A communication port 94 for communicating between the conveying chamber 91 and the waste toner accommodating chamber 92 is formed at the rear end of the partition 93.

The conveying chamber 91 is defined as an upper space of the second waste toner accommodating portion 45, in which the second conveying auger 95 is housed. The second conveying auger 95 extends in the left-right direction and includes an auger shaft whose both ends are rotatably supported by the both side walls of the second waste toner accommodating portion 45 (conveying chamber 91) and an auger blade formed around the auger shaft and helically extending in the left-right direction.

The waste toner accommodating chamber 92 is defined as a lower space of the second waste toner accommodating portion 45, in which waste toner (e.g., transfer residual toner) collected by the cleaning roller 42 is stored.

As illustrated in FIG. 3, a plurality of paper feeding ribs 97 each formed into substantially a triangular shape as viewed from a side are vertically provided on the front surface of the second waste toner accommodating portion 45 that faces the paper guide section 46 (described later). The paper feeding ribs 97 are arranged spaced apart from each other in the left-right direction. The front end surface of each paper feeding rib 97 extends substantially in the up-down direction.

(3-3) Connection Portion

The connection portion 81 connects the left ends of the first waste toner accommodating portion 44 and the second waste toner accommodating portion 45. The front end of the connection portion 81 is opposed to the left side of the first waste toner accommodating portion 44 from left to right. The rear end of the connection portion 81 is opposed to the left side of the second waste toner accommodating portion 45 from left to right. A connection/conveying chamber 98 formed into substantially an ellipsoidal shape extending from the front side lower end of the connection portion 81 to rear side upper end is defined in the connection portion 81.

The front end of the connection/conveying chamber 98 is opposed to the first conveying auger 87 of the first waste toner accommodating portion 44 in the left-right direction and communicates with the inside of the first waste toner accommodating portion 44 at the opposing portion.

The rear end of the connection/conveying chamber 98 is opposed to the second conveying auger 95 of the second waste toner accommodating portion 45 in the left-right direction and communicates with the inside (conveying chamber 91) of the second waste toner accommodating portion 45 at the opposing portion.

The connection/conveying chamber 98 includes a belt conveying section 101 (an example of a first conveying member).

The belt conveying section 101 includes a driving pulley 102, a driven pulley 103, and a conveying belt 104. The driving pulley 102 is disposed at the lower side of the front end of the connection/conveying chamber 98. The driven pulley 103 is disposed at the upper side of the rear end of the connection/conveying chamber 98. The conveying belt 104 is spanned between the driving pulley 102 and the driven pulley 103.

An engagement plate 99 is provided between the right ends of the first waste toner accommodating portion 44 and the second waste toner accommodating portion 45 as illustrated in FIG. 2. The engagement plate 99 is formed into substantially a rectangular shape as viewed from a side and abuts against the rear end surface of the first waste toner accommodating portion 44 and the front end surface of the second waste toner accommodating portion 45. As a result, the right ends of the first waste toner accommodating portion 44 and the second waste toner accommodating portion 45 are relatively positioned spaced apart from each other in the front-rear direction.

The upper end of the engagement plate 99 is integrally formed with the right side second flange portion 59 so as to be held by the right side second side plate 56 of the drum frame 51.

(3-4) Paper Guide Section

The paper guide section 46 is formed as an opening. The paper guide section 46 penetrates the cleaning unit 41 in the up-down direction at the front-rear midway portion of the cleaning unit 41. More specifically, the paper guide section 46 is defined by the first waste toner accommodating portion 44, the second waste toner accommodating portion 45, the connection portion 81, and the engagement plate 99. The left-right direction width of the paper guide section 46, that is, a distance between the connection portion 81 and the engagement plate 99 is set larger than the width of the paper sheet P.

(3-5) Movement of Paper Sheet Passing Through Paper Guide Section

As described above, the paper sheet P that has passed through the opposing portion between the intermediate transfer belt 22 and the secondary transfer roller 24 is guided by the paper guide section 46 to pass through the cleaning unit 41 in the up-down direction toward the fixing unit 17.

At this time, the leading end (downstream side end in the feeding direction) of the paper sheet P is moved upward while abutting against the front end surfaces of the paper feeding ribs 97 provided on the front end surface of the second waste toner accommodating portion 45. As a result, the paper sheet P is smoothly guided toward the fixing unit 17 along the front end surfaces of the paper feeding ribs 97.

(4) Cleaning Operation

As described above, after the color image has been secondary-transferred onto the paper sheet P, the transfer residual toner (waste toner) remains on the peripheral surface of the intermediate transfer belt 22. When the waste toner has reached to a position opposite to the cleaning roller 42 with the circulation of the intermediate transfer belt 22, the waste toner is moved from the intermediate transfer belt 22 to the peripheral surface of the cleaning roller 42. As a result, the waste toner is removed from the peripheral surface of the intermediate transfer belt 22.

Thereafter, with a rotation of the cleaning roller 42, the waste toner carried by the peripheral surface of the cleaning roller 42 reaches a position opposite to the metal roller 85 and then moves from the peripheral surface of the cleaning roller 42 to the peripheral surface of the metal roller 85 to be adhered thereto.

Then, when the metal roller 85 rotates, the waste toner adhered to the peripheral surface of the metal roller 85 is scraped by the scraping member 86 and dropped in the first waste toner accommodating portion 44.

Thereafter, the waste toner that has dropped in the first waste toner accommodating portion 44 is conveyed leftward inside the first waste toner accommodating portion 44 by a rotation of the first conveying auger 87 to be conveyed from the first waste toner accommodating portion 44 to the connection/conveying chamber 98.

The waste toner that has been conveyed to the connection/conveying chamber 98 is conveyed in the upper-rear direction by the belt conveying section 101 and is thereafter conveyed from the rear side upper end of the belt conveying section 101 to the conveying chamber 91 of the second waste toner accommodating portion 45.

The waste toner that has been conveyed to the conveying chamber 91 is conveyed rightward by a rotation of the second conveying auger 95 and is dropped in the waste toner accommodating chamber 92 through the communication port 94 formed in the partition 93. In such a manner, the waste toner is stored in the waste toner accommodating chamber 92.

3. Attachment of Developer Cartridge to Drum Unit

Figure 5:
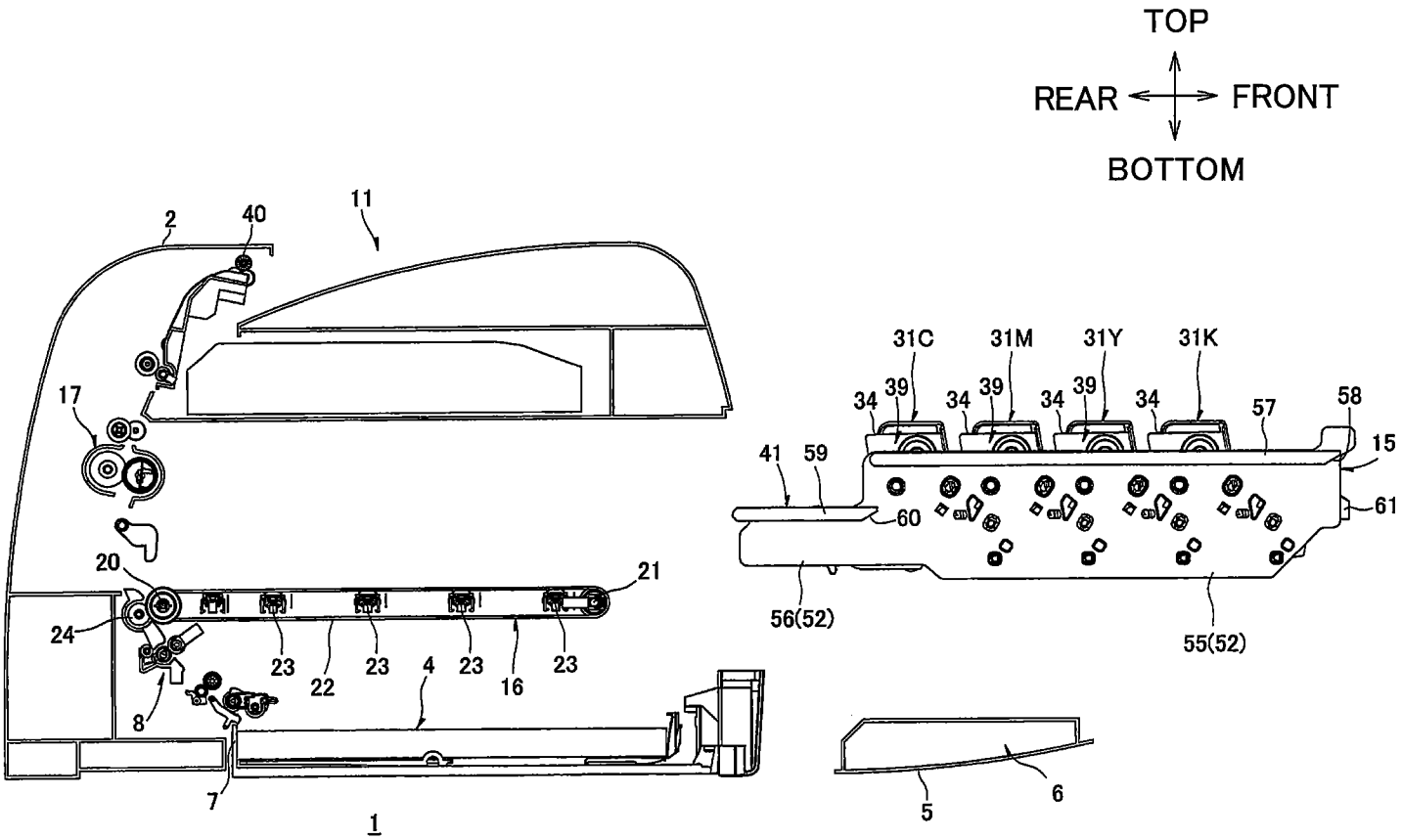
FIG. 5 is a cross-sectional side view showing an attachment/detachment operation of a plurality of developer cartridges.

As illustrated in FIG. 5, attachment of the developer cartridge 31 to the drum unit 15 is performed in a state where the drum unit 15 is positioned at the pull-out position at which the drum unit 15 is outside the main casing 2.

At this time, the front cover 5 is positioned at an opening position at which the upper end (free-end portion) is separated from the main casing 2 and inclined frontward.

First, the developer cartridge 31 is disposed above the drum unit 15. In this state, the developing roller 36 is positioned at the relatively lower side and the toner accommodating portion 39 is positioned at the relatively upper side.

Then, the developer cartridge 31 is moved downward. As a result, the developer cartridge 31 goes between both the first side plates 55 of the drum frame 51. When the developer cartridge 31 is moved further downward, the peripheral surface of the developing roller 36 abuts against the peripheral surface of the corresponding photosensitive drum 32. In this state, further downward movement of the developer cartridge 31 is restricted by a restricting portion (not illustrated) provided in each first side plate 55 to thereby complete the attachment of the developer cartridge 31 to the drum unit 15.

After the completion of the housing operation of the developer cartridge 31 in the drum unit 15, the drum unit 15 is moved from the pull-out position to the housing position.

Figure 6:
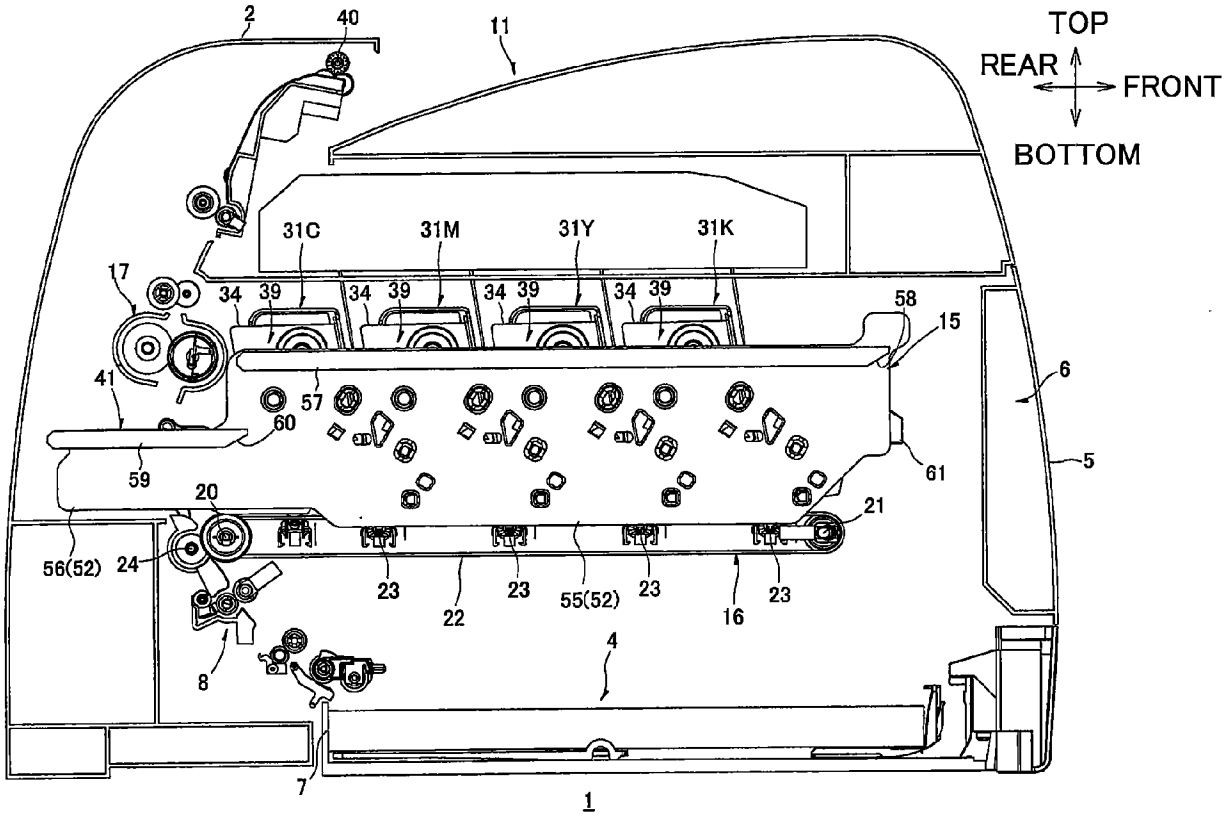
FIG. 6 is a cross-sectional side view showing a housing operation of the drum unit.

As illustrated in FIGS. 5 and 6, when the drum unit 15 is moved to the housing position, the handle portion 61 of the drum unit 15 is grasped to move the drum unit 15 rearward. As a result, the first and second flange portions 57 and 59 are guided rearward along a rail member (not illustrated) formed in the main casing 2.

Afterward, further rearward movement of the drum unit 15 brings a roller member (not illustrated) provided at the rear end of the rail member into contact with the first and second inclined surfaces 58 and 60 to cause the entire drum unit 15 to move to the lower rear side along the first and second inclined surfaces 58 and 60. Then, each photosensitive drum 32 abuts against the peripheral surface of the intermediate transfer belt 22 to restrict the further rearward and downward movement of the drum unit 15 to complete the movement of the drum unit 15 to the housing position in the main casing 2.

The pull-out operation of the drum unit 15 outside the main casing 2 can be performed in the reverse order to the order of the above procedure.

4. Functions/Effects

As described above, the cleaning unit 41 is disposed above the intermediate transfer belt 22 and includes the cleaning roller 42 and the casing 43 that supports the cleaning roller 42. The cleaning roller 42 is disposed downstream of the secondary transfer roller 24 and on the upstream side of the upstream most photosensitive drum 32 in the travel direction of the intermediate transfer belt 22. The cleaning roller 42 is brought into contact with the intermediate transfer belt 22 to collect the waste toner remaining on the intermediate transfer belt 22 that has passed through the secondary transfer roller 24. The paper guide section 46 is formed in a midway portion of the casing 43 in the front-rear direction, and the conveying path 8 passes through the paper guide section 46. With this configuration, the size reduction of the color printer 1 can be achieved while ensuring the capacity of the casing 43 (cleaning unit 41).

Further, the paper guide section 46 is configured to guide the paper sheet P passing between the intermediate transfer belt 22 and the secondary transfer roller 24 toward the fixing unit 17 disposed above the cleaning unit 41. With this configuration, the paper sheet P can be conveyed to the fixing unit 17 smoothly.

Further, the paper guide section 46 is formed as the opening portion defined by the first waste toner accommodating portion 44, the second waste toner accommodating portion 45, the connection portion 81, and the engagement plate 99. With this configuration, the mechanical strength of the casing 43 can be secured. As a result, the paper sheet P can be guided while ensuring the mechanical strength of the casing 43.

The casing 43 includes the second waste toner accommodating portion 45 for accommodating the waste toner. The second waste toner accommodating portion 45 is provided on the opposite side (rear side) of the cleaning roller 42 with respect to the paper guide section 46. There is no restriction as to arrangement of members for feeding operation of the paper sheet P in a region on the rear side of the cleaning roller 42 with respect to the paper guide section 46. Thus, a sufficient size can be ensured for the second waste toner accommodating portion 45.

The cleaning unit 41 includes the first conveying auger 87 and the belt conveying section 101 that convey the waste toner collected by the cleaning roller 42 toward the second waste toner accommodating portion 45. With this configuration, the waste toner can smoothly be conveyed to the second waste toner accommodating portion 45.

The first conveying auger 87 conveys leftward the waste toner collected by the cleaning roller 42. The belt conveying section 101 is provided on the left side of the casing 43 and conveys the waste toner that has been conveyed to the first conveying auger 87 to the second waste toner accommodating portion 45. As a result, the waste toner can efficiently be conveyed to the second waste toner accommodating portion 45.

When being projected in the opposing direction between the photosensitive drum 32 and the intermediate transfer belt 22 (i.e., up-down direction), the fixing unit 17 and the cleaning unit 41 are disposed so as to at least partially overlap each other. As a result, a distance between the fixing unit 17 and the cleaning unit 41 can be reduced. Further, the front-rear direction size can be reduced as compared to a configuration in which the fixing unit 17 and the cleaning unit 41 are disposed so as not to overlap each other when being projected in the up-down direction, with the result that the size of the color printer 1 can be reduced further.

The color printer 1 includes the drum unit 15 that integrally retains the photosensitive drums 32 and the cleaning unit 41. The drum unit 15 is provided so as to be movable between the housing position at which the drum unit 15 is housed in the main casing 2 and the pull-out position at which the drum unit 15 is outside the main casing 2. With the above configuration, moving the drum unit 15 to the pull-out position allows the cleaning unit 41 and the photosensitive drums 32 to be pulled out integrally outside the main casing 2, making it easy to perform replacement and maintenance works for the cleaning unit 41.

<Second Embodiment>

In the color printer 1 illustrated in FIG. 1, the cleaning unit 41 is provided in the drum unit 15, and the drum unit 15 is attached/detached to/from the main casing 2.

Figure 7:
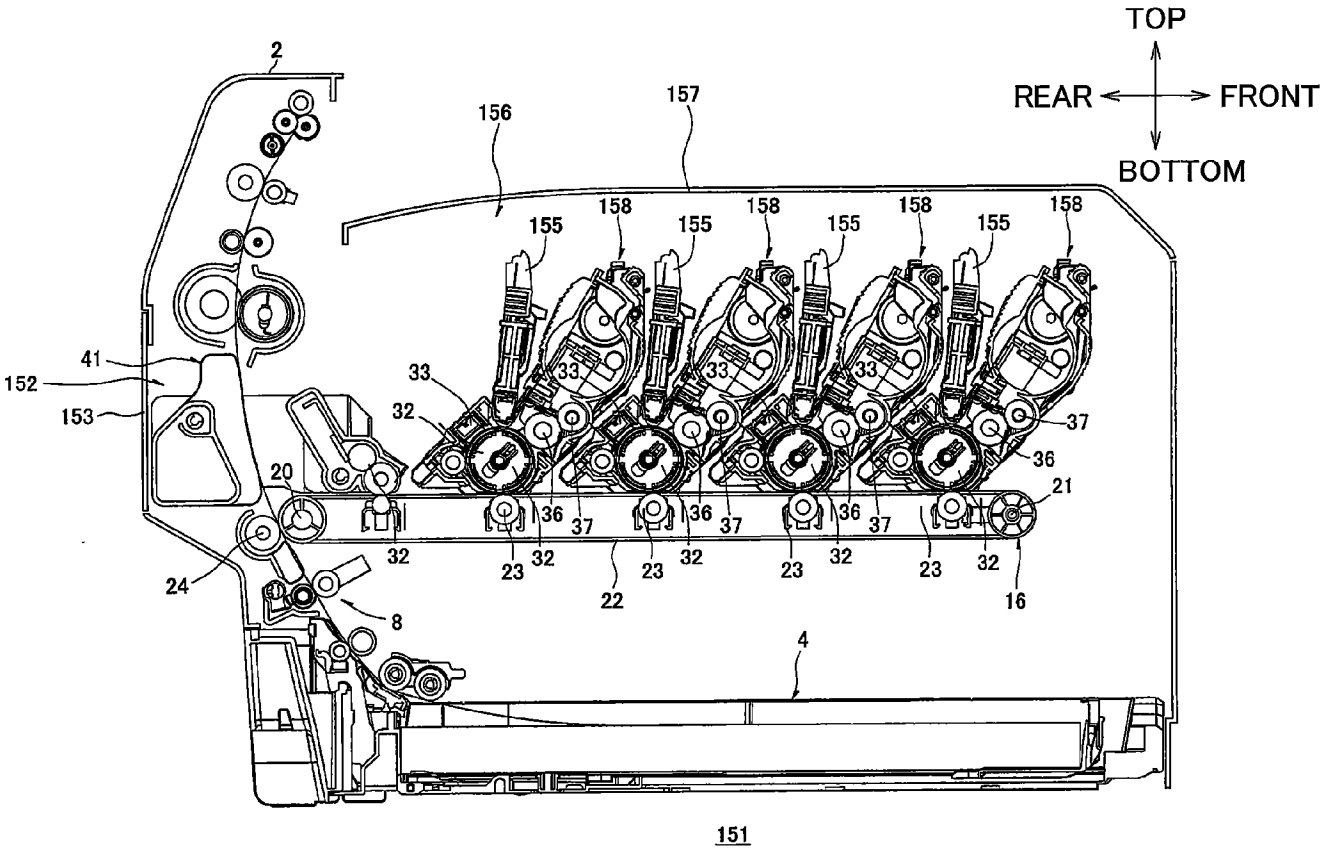
FIG. 7 is a cross-sectional side view of a color printer according to a second embodiment of the present invention.
Figure 8:
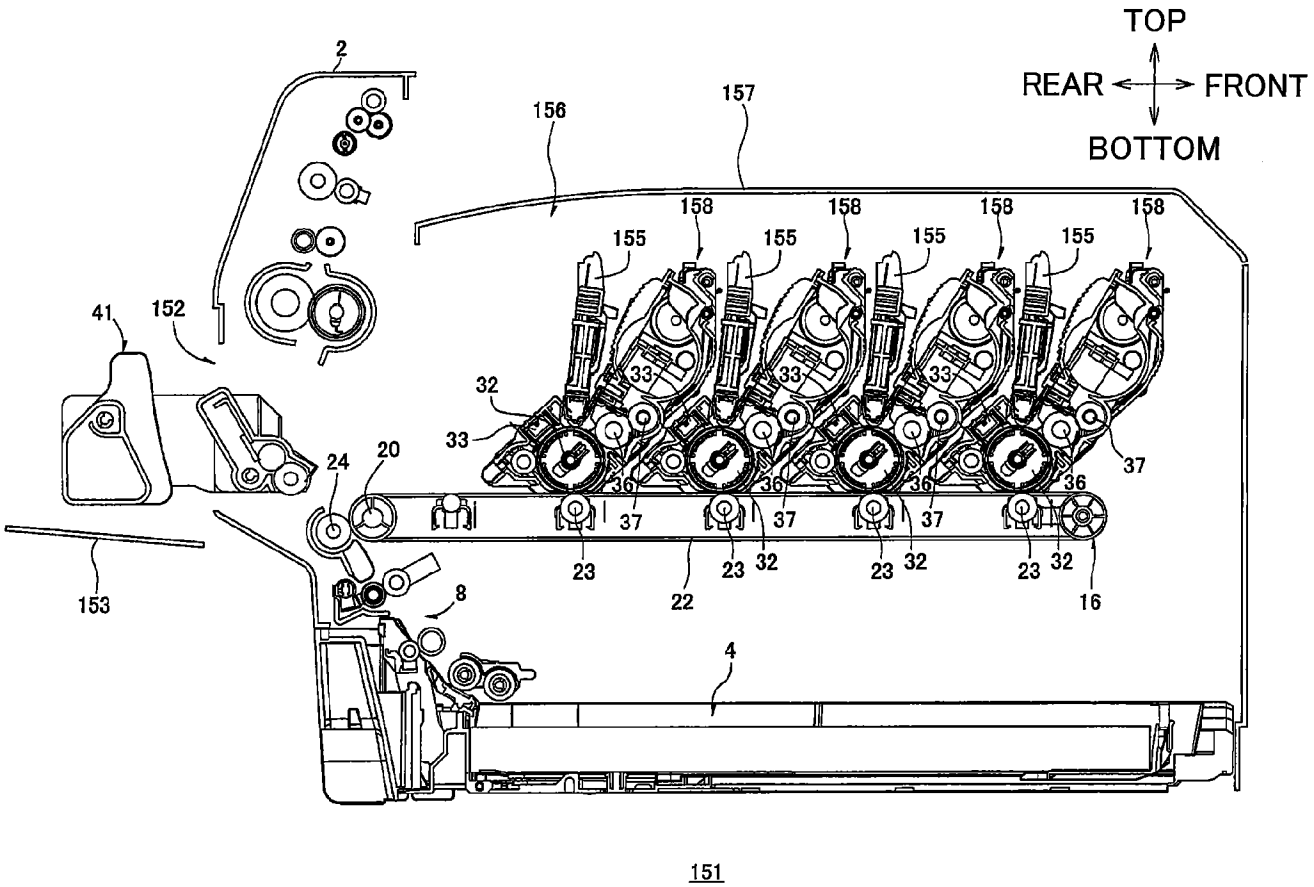
FIG. 8 is a cross-sectional side view showing an attachment/detachment operation of a cleaning unit in the color printer shown in FIG. 7.

Alternatively, in the present embodiment, as illustrated in FIGS. 7 and 8, the cleaning unit 41 is directly attached/detached to/from the main casing 2 without providing the drum unit 15.

In a color printer 151 illustrated in FIGS. 7 and 8, a main body side opening portion 152 (an example of a main casing side opening) for communicating between the inside and outside of the main casing 2 is formed in the front side wall of the main casing 2. Further, a front cover 153 capable of opening/closing the main body side opening portion 152 is formed on the front side wall of the main casing 2.

The main body side opening portion 152 has an up-down direction width and a left-right direction width allowing passage of the cleaning unit 41.

Thus, opening the front cover 153 to open the main body side opening portion 152 allows the cleaning unit 41 to be pulled out frontward through the main body side opening portion 152. This configuration allows the cleaning unit 41 to be attached/detached to/from the main casing 2.

An upper side opening portion 156 is formed in the upper wall of main casing 2. Further, a top cover 157 capable of opening/closing the upper side opening portion 156 is provided in the main casing 2.

Four LED units 155 are supported at the inner surface (lower surface) of the top cover 157 so as to move following a pivotal movement of the top cover 157.

When the top cover 157 is opened, the four LED units 155 move upward in conjunction with the pivotal movement of the top cover 157. As a result, the four LED units 155 escape from the main casing 2.

Four process cartridges 158 corresponding respectively to the four LED units 155 are arranged in the main casing 2, spaced apart from each other in the front-rear direction. Each process cartridge 158 retains the photosensitive drum 32 and the developing roller 36.

After the four LED units 155 have escaped from the main casing 2 with the opening of the top cover 157, the process cartridges 158 can be attached/detached to/from the main casing 2 through the upper side opening portion 156.

Even in such a configuration, the same effects as in the first embodiment can be obtained.

<Other Embodiments>

Although the first and second embodiments of the present invention have been described as above, the present invention may be practiced in other embodiments.

For example, in the above embodiments, the paper guide section 46 is formed as the opening portion defined by the first waste toner accommodating portion 44, second waste toner accommodating portion 45, connection portion 81, and the engagement plate 99.

However, the paper guide section 46 may be formed by a region inside substantially a U-like shape as viewed from above opened leftward or rightward. Even in a color printer adopting such a paper guide section 46, the same effects as in the color printer 1 of FIG. 1 can be obtained.

What is claimed is:

1. An image forming device comprising:

an intermediate transfer belt;

a fixing unit configured to fix an image onto a recording medium;

a first cartridge accommodating developing agent therein;

a second cartridge accommodating developing agent therein and spaced away from the first cartridge in a first direction;

a cleaning member configured to collect residual toner deposited on the belt;

a waste toner box configured to accommodate therein the residual toner collected by the cleaning member;

a main casing including:

a first wall; and a second wall spaced away from the first wall in the first direction, a distance between the first wall and the fixing unit being smaller than a distance between the second wall and the fixing unit; and a guide configured to guide the recording medium, wherein the waste toner box is disposed between the guide and the first wall.

2. The image forming device according to claim 1, wherein the first wall has an opening through which the waste toner box passes.

3. The image forming device according to claim 2, further comprising a cover configured to expose the opening and to cover the opening.

4. The image forming device according to claim 2, wherein the waste toner box is under the fixing unit.

5. The image forming device according to claim 1, wherein the intermediate transfer belt spans between a first roller and a second roller.

6. The image forming device according to claim 5, further comprising a secondary transfer roller opposed to the first roller across the intermediate transfer belt, wherein the waste toner box is above the secondary transfer roller.

7. The image forming device according to claim 1, wherein the fixing unit has a heating roller and a pressure roller which, along with the heating roller, is configured to pass the recording medium.

8. The image forming device according to claim 1, wherein the cleaning member is a roller.

9. The image forming device according to claim 1, wherein the waste toner box has a partition partitioning an inner space of the waste toner box into a first chamber and a second chamber.

10. The image forming device according to claim 9, further comprising an auger accommodated in the first chamber.

11. The image forming device according to claim 10, further comprising a communication port through which waster toner conveyed by the auger passes from the first chamber to the second chamber.

12. The image forming device according to claim 9, wherein the second chamber is lower than the first chamber.

13. The image forming device according to claim 1, wherein the main casing has an upper wall, the upper wall having an upper opening through which the first cartridge and the second cartridge pass.

14. A cleaning unit detachably attachable to an image forming device, the cleaning unit comprising:

a cleaning roller;

a waste toner accommodating chamber for accommodating waste toner; and a paper guide disposed between the cleaning roller and the waste toner accommodating chamber.

15. The cleaning unit according to claim 14, wherein the paper guide has paper feeding ribs.

16. The cleaning unit according to claim 14, further comprising:

a first waste toner accommodating portion accommodating the cleaning roller;

a second waste toner accommodating portion having the waste toner accommodating chamber;

a connection portion connecting one end of the first waste toner accommodating portion and one end of the second waste toner accommodating portion; and an engagement plate provided between another end of the first waste toner accommodating portion and another end of the second waste toner accommodating portion, wherein the paper guide is defined by the first waste toner accommodating portion, the second waste toner accommodating portion, the connection portion and the engagement plate.

17. The cleaning unit according to claim 16, wherein the connection portion includes a conveying member which conveys the waste toner from the first waste toner accommodating portion to the second waste toner accommodating portion.

18. The cleaning unit according to claim 17, wherein the connection portion further includes a connection/conveying chamber which accommodates the conveying member.

* * * * *